US009212483B2

(12) United States Patent
Permesang

(10) Patent No.: US 9,212,483 B2
(45) Date of Patent: Dec. 15, 2015

(54) DOUBLE-FLOOR DESIGN

(75) Inventor: Claus Permesang, München (DE)

(73) Assignee: ARSRATIO HOLDING GMBH, Innsbruck (AT)

( * ) Notice: Subject to any disclaimer, the term of this patent is extended or adjusted under 35 U.S.C. 154(b) by 0 days.

(21) Appl. No.: 13/884,736

(22) PCT Filed: Nov. 10, 2011

(86) PCT No.: PCT/DE2011/075265

§ 371 (c)(1),
(2), (4) Date: May 31, 2013

(87) PCT Pub. No.: WO2012/083940

PCT Pub. Date: Jun. 28, 2012

(65) Prior Publication Data

US 2013/0232892 A1 Sep. 12, 2013

(30) Foreign Application Priority Data

Nov. 10, 2010 (DE) ..... 10 2010 051 003

(51) Int. Cl.
*E04B 5/43* (2006.01)
*E04F 15/024* (2006.01)

(52) U.S. Cl.
CPC ..... *E04B 5/43* (2013.01); *E04F 15/02452* (2013.01); *E04F 15/02458* (2013.01); *E04F 15/02476* (2013.01)

(58) Field of Classification Search
CPC ..... E04B 5/43; E04F 15/02458; E04F 15/02476; E04F 15/02452
USPC ..... 52/126.5, 126.6, 126.1, 126.7, 263, 52/582.1, 582.2, 584.1, 586.1
See application file for complete search history.

(56) References Cited

U.S. PATENT DOCUMENTS

| | | | | |
|---|---|---|---|---|
| 2,401,587 | A * | 6/1946 | Smith | 52/474 |
| 2,956,653 | A | 10/1960 | Liskey et al. | |
| 3,606,704 | A * | 9/1971 | Denton | 52/167.8 |
| 4,738,940 | A | 4/1988 | Dufresne et al. | |
| 4,922,670 | A * | 5/1990 | Naka et al. | 52/126.6 |
| 5,205,087 | A * | 4/1993 | Jines | 52/6 |
| 5,333,423 | A * | 8/1994 | Propst | 52/126.6 |
| 5,398,466 | A * | 3/1995 | Oyama et al. | 52/126.6 |
| 5,791,096 | A * | 8/1998 | Chen | 52/126.6 |
| 5,904,009 | A * | 5/1999 | Huang | 52/126.6 |
| 6,763,643 | B1 * | 7/2004 | Mårtensson | 52/586.1 |

(Continued)

FOREIGN PATENT DOCUMENTS

| | | |
|---|---|---|
| DE | 19958225 A | 6/2001 |
| EP | 0162733 | 11/1985 |

(Continued)

*Primary Examiner* — Adriana Figueroa
*Assistant Examiner* — Jessie Fonseca
(74) *Attorney, Agent, or Firm* — Lucas & Mercanti, LLP; Klaus P. Stoffel

(57) ABSTRACT

A double-floor design with flooring panels and a support structure to be placed on a sub-floor on which the flooring panels can be laid abutting one another edge to edge and spaced from the sub-floor. The support structure includes support rails which extend below the joints between the flooring panels along the joints. The flooring panels and support rails include devices for vertically fitting the flooring panels onto the support rails, wherein the edge faces of the flooring panels forming the joints are pressed together horizontally.

16 Claims, 7 Drawing Sheets

(56) References Cited

U.S. PATENT DOCUMENTS

| | | | | |
|---|---|---|---|---|
| 2003/0051420 | A1 | 3/2003 | Leon | |
| 2007/0186498 | A1 * | 8/2007 | Buzon | 52/263 |
| 2007/0220822 | A1 | 9/2007 | Permesang | |
| 2010/0006481 | A1 | 1/2010 | Waites | |

FOREIGN PATENT DOCUMENTS

| | | | |
|---|---|---|---|
| EP | 1760222 | Y | 3/2007 |
| EP | 1788166 | | 5/2007 |
| FR | 2905395 | | 3/2008 |
| WO | 2005040521 | Y | 10/2001 |

* cited by examiner

DOUBLE-FLOOR DESIGN

The present application is a 371 of International application PCT/DE2011/075265, filed Nov. 10, 2011, which claims priority of DE 10 2010 051 003.3, filed Nov. 10, 2010, the priority of these applications is hereby claimed and these applications are incorporated herein by reference.

BACKGROUND OF THE INVENTION

The invention pertains to a double-floor construction with floor plates and a support structure to be built on a subfloor, on which structure the floor plates can be laid with their edges abutting each other a certain distance from the subfloor.

Flooring which can be laid with little effort is known from EP 162 733 A2; it comprises floor plates with a stiff lower backing layer and an upper decorative layer in the form of tiling, for example. An intermediate layer is foamed or sprayed onto the backing layer and the decorative layer. The intermediate layer merges integrally with an edging element and with contrivances for connecting the edges of the floor plates to each other, wherein the edging and the contrivances are produced simultaneously with the intermediate layer.

SUMMARY OF THE INVENTION

The invention is based on the goal of creating a new double-floor construction of the type indicated above which can be manufactured with little effort, which comprises a high degree of impermeability to liquid and air, and the floor plates of which can be quickly replaced.

The inventive double-floor construction achieving this goal is characterized in that the support structure comprises support rails, which extend underneath and along the butt joints between the floor plates, and in that the floor plates and support rails comprise contrivances which allow the floor plates to be set down vertically onto the support rails under horizontal compression of the edges forming the butt joints of the floor plates.

It is advantageous that the floor plates need to be moved only vertically when they are to be connected to each other and when they are to be removed; no cumbersome horizontal movements to connect the plates to each other are required. If desired, an individual floor plate can be easily removed from the flooring assembly and replaced by, for example, a floor plate with an integrated electrical outlet. The horizontal pressure which the floor plates exert against each other ensures that the floor covering will be leak-proof.

In a preferred embodiment of the invention, each of the support rails comprises a longitudinal channel extending under the associated butt joint; hooking sidepieces formed on the edges of the floor plates can be inserted into these channels. The transverse forces which arise during insertion press the floor plates together along their edges; this is associated advantageously with a stabilizing effect and improves the sealing function of the flooring.

The floor plates can preferably be set down onto the support rails in such a way that they latch themselves into the rails.

In a further elaboration of the invention, each of the support rails comprises a U-shaped section, which forms the longitudinal channel, the material of this U-section being different from that of the rest of the support rail. This U-section can be produced with a high degree of precision from, for example, aluminum or plastic, whereas the remainder of the support rail can be made out of a steel section, especially a steel U-section, with wider manufacturing tolerances.

It is advantageous for the first U-section, which can have a latching projection on the outward-facing surface to latch with the other part of the support rail, to comprise a projection, especially a latching projection, on each of the inward-facing surfaces of the U-section, to which the previously mentioned hooking sidepiece can latch.

In a further elaboration of the invention, contrivances to allow the vertical placement of the floor plates onto the support rails are formed on an intermediate layer of the floor plate, which is foamed or sprayed onto the backing layer and the decorative layer. This intermediate layer can consist of, for example, polyurethane foam.

After the floor plates, which have been installed with their edges abutting each other under a certain horizontal pressure and which are also connected by tongue-and-groove joints produced via the intermediate layer, and after the tongue-and-groove joints between the floor plates and the U-section produced via the intermediate layer, the U-section forming the longitudinal channel, because it is closed off at the bottom, represents, as it were, a third sealing plane.

In one embodiment of the invention, the support structure comprises uprights, which are preferably arranged underneath the corners of the floor plates and which are designed to hold the support rails.

These uprights can comprise seatings, preferably edge slots, to accept the support rails, which are laid continuously across several uprights. It is advantageous for the support structure also to comprise support rails which extend between and perpendicular to the support rails laid continuously over several uprights.

These support rails extending between the continuously laid support rails are advisably designed so that they can be suspended from the uprights.

In a further elaboration of the invention, the uprights comprise an adjustable three-point or four-point base by which they rest on the subfloor. Adjustments can be made by changing the height and angle of the upright, e.g., by manipulating it from above by inserting a tool from above into a sleeve, into which a foot of the upright is screwed from underneath, this foot having an engagement slot for the tool at its upper end.

In another embodiment, the three-point or four-point base can be adjusted remotely through the laid floor plates by, for example, the use of magnetism. For example, a set of gears actuated externally by a magnetic coupler can be used to adjust the height. This makes it possible to readjust the flooring after it has been laid. Preferably, however, the support structure is adjusted precisely before the floor plates are laid.

It is also possible to make adjustments by means of, for example, a single screw located at each of the intersections of the joints between the floor plates. A removable cap can cover an insertion opening for a screwdriver and be removed when it is desired to make an adjustment. It is possible in this way to readjust the flooring without removing any of the floor plates.

The uprights are preferably designed as rectangular boxes open at one end or at both ends, wherein the walls of the box which face each other comprise openings at the edges, especially slots, to form the previously mentioned seating or to form contrivances for the suspension of the support rails.

The vertical uprights can be easily set up by themselves first. Then the support rails, which are to be oriented horizontally, are then installed on the uprights in such a way that they extend continuously over several of them. Stops, especially slots therein, can hold the uprights precisely in position. Alternatively, the support rails can comprise markings for the position of the uprights. Between two longitudinal beams created in this way, it is then possible to suspend the perpendicular connecting beams from the uprights between the support rails forming the two longitudinal rails. Thus square receptacles of precise dimensions are formed, which accept the floor plates provided with latching elements and brace them against each other.

This bracing function can also be served by the self-adjustment of the floor plates themselves, especially when there is a certain amount of play in the latching connections. Because the floor plates fit precisely, they cause the support structure to shift where necessary all the way around and thus bring the support elements into their exact positions.

The shorter connecting support rails extending between the continuously laid support rails can comprise slots at their ends so that they can be suspended from the uprights.

BRIEF DESCRIPTION OF THE DRAWING

The invention is explained in greater detail below on the basis of exemplary embodiments and the attached drawings, which pertain to one of these examples.

DETAILED DESCRIPTION OF THE INVENTION

In the exemplary embodiment shown here, a double-floor construction comprises square floor plates 1, which are laid with their edges abutting each other on a support structure. Rectangular floor plates can also be used, however, and it is also possible to omit the suspended connecting beam. The support structure mounted on the subfloor also comprises uprights, arranged under the corners of the abutting floor plates 1.

Support rails 3 and 4 are arranged on the uprights 2; each of the support rails 3 extends continuously over several uprights 2, and each of the support rails 4 extends only between two such support rails 3 and two uprights 2.

Figure 6:
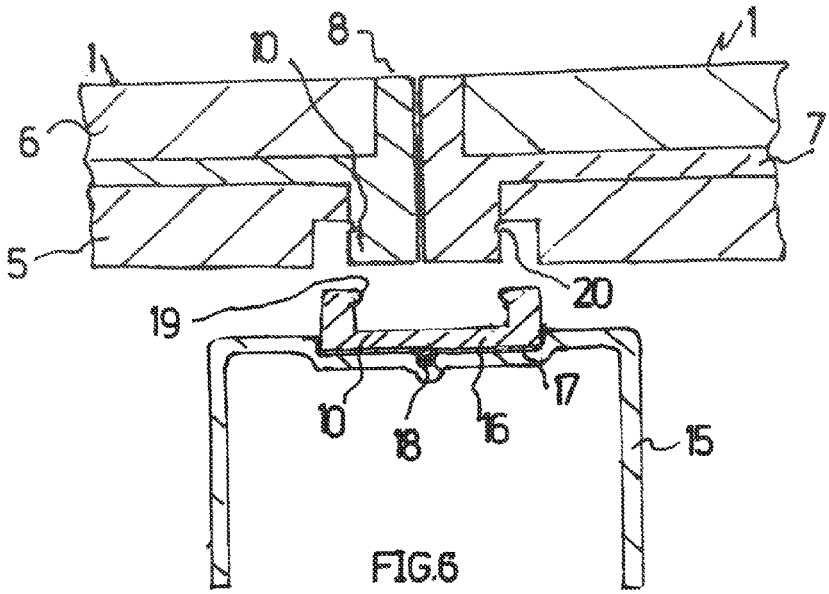
FIGS. 6 and 7 show diagrams which explain the butt joint between two floor plates of the double-floor construction of FIG. 1.
Figure 7:
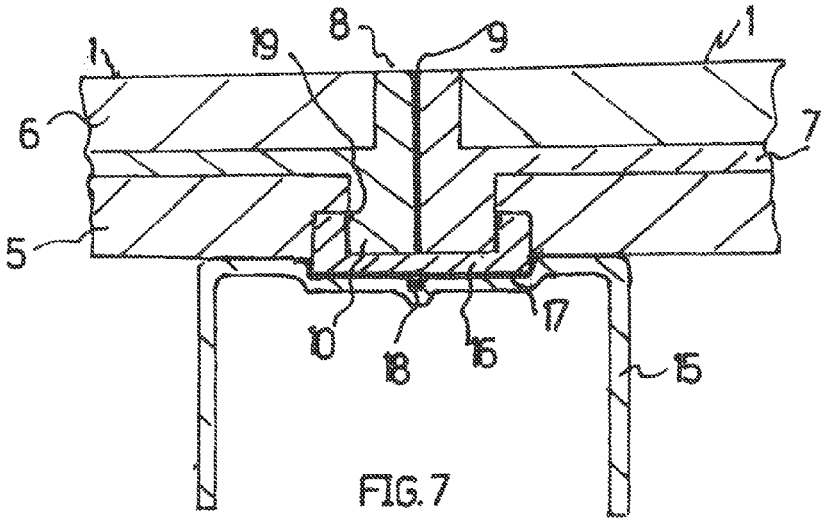

As can be seen in FIGS. 6 and 7, the floor plates 1 consist of several layers, namely, a stiff backing layer 5, a decorative layer 6, and an intermediate layer 7 foamed or sprayed onto the backing layer 5 and the decorative layer 6. The stiff backing layer 5, which gives the floor plate stability, is preferably made out of recycled material or some other incombustible material (e.g., fiber-reinforced plasterboard or the like). The decorative layer can comprise, for example, tiles or some other material with a decorative surface. The foamed-on or sprayed-on intermediate layer preferably consists of polyurethane foam.

The intermediate layer 7 merges integrally with the edging 8, which extends around the floor plate 1; this edging forms a butt joint 9 with the edging of the adjacent floor plate. Also connected integrally to the intermediate layer 7 is a hooking sidepiece 10. Both the hooking sidepiece 10 and the edging 8 are produced simultaneously with the intermediate layer 7 by foaming or spraying. It is also possible as an alternative, however, to embed ready-made connecting elements (e.g., extruded parts) in the foam. In contrast to the peripheral edging 8, the hooking sidepieces 10 do not extend all the way around but are interrupted at the corners of the plate.

The uprights 2 are designed essentially as hollow rectangular boxes, the opposite ends of which are open. The horizontal cross section of the box is square and has four side walls 11. Each of the side walls 11 merges at the corners with an internally threaded vertical sleeve 12. The feet 13 of the uprights are screwed into these sleeves 12. At the top end, the threaded bolts of the feet 13 advisably comprise an opening for the insertion of a screwdriver, which can be introduced from above into the sleeve 12. If the base body of the upright is produced as an extruded part, the inside thread mentioned above will be provided in the form of a pressed-in sleeve.

Each of the side walls 11 comprises two edge slots at the upper edge.

In the example shown, both the continuous support rails 3 and the shorter support rails 4 each consist of a U-shaped section 15 of steel and a U-shaped section 16 made, for example, of aluminum or plastic. An indentation 17 in the base of the U-shaped steel section 15 accepts the section 16, the base of which comprises a projection 18 on the outside surface. Additional projections 19 are formed on the inside of the section 16, one at the end of each of the sides of the U. These are latching projections, which are designed to engage in a recess 20 in the hooking sidepiece 10. The latching projections form a second sealing plane.

The sections 15, 16 do not necessarily have to have the shape of a "U", and materials others than those mentioned can also be considered.

Both the support rails 3 and the support rails 4 comprise edge slots 21 in both sides of the U-section 15.

For the production of a double-floor construction from the components described above, the uprights 1 are first arranged on the subfloor in the positions corresponding to the abutting corners of the floor plates 1. Then the continuous support rails 3 are laid in place, the sides of the U of the steel sections 15 engaging in the associated edge slots 14 in the side walls 11 of the support elements 2. The slots 21 in the sides of the U automatically ensure the precise positioning of the support rails 3, 4. Instead of the slots 21 in the support rails 3 and/or 4, it would also be possible to provide suitable markings to facilitate the installation of the support structure with precision through the longitudinal displacement of the support rails 3 and/or 4, while still making it possible to compensate for manufacturing tolerances. In the absence of slots 21 customized to the dimensions of specific floor plates or other stops to determine the horizontal positioning of the support rails 3, 4 on the support elements 2, the support structure can be easily adapted to accommodate floor plates of different dimensions. In certain cases, only the support rails 4 need to be adapted.

After the support rails 3, 4 have been installed in their proper horizontal positions, the support structure can now be adjusted by using a screwdriver or wrench to raise or lower the adjustable feet 13 of the uprights 2 from above by screwing the feet into or out of the sleeves 12 to a greater or lesser extent until each upright 2 is resting solidly on the subfloor without the danger of tipping.

Then the floor plates 1 can be installed. Their hooking sidepieces 10 are inserted into the channel formed by, for example, the aluminum section 16, wherein the edges of the floor plates 2 are thus pressed against each other to form the butt joint 9.

Finally, vertical pressure is applied to the floor plates. The slots sized to fit the dimensions of the floor plates can comprise enough play that the support rails can shift their positions slightly all the way around the plate to conform to the positions of the hooking sidepieces of the floor plates, which are highly precise. In a corresponding manner, the main flooring formed by the floor plates ensures the precise horizontal adjustment of the overall system.

The uprights can also be tall enough that the flooring could be used to produce a stage floor. For this purpose, stronger connections would be provided between the support rails and the uprights; they could, for example, be screwed together.

Alternatively, transverse stiffeners, diagonal bracings, or the like could be provided, especially in cases where the uprights are quite tall.

Figure 8:
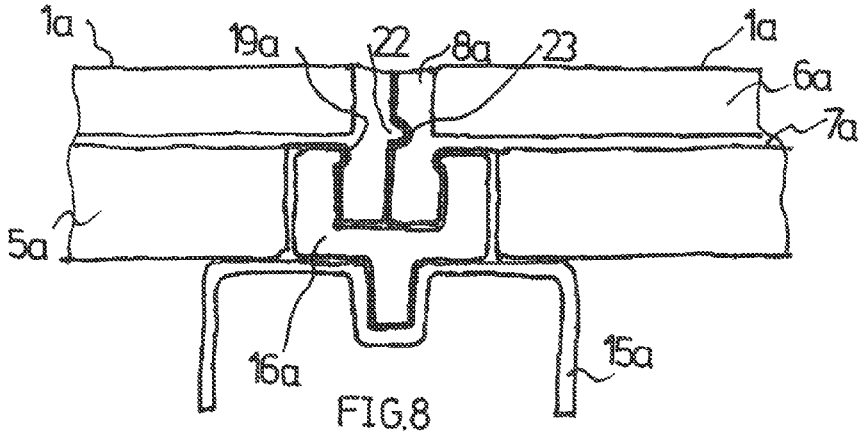
FIG. 8 shows a butt joint between two floor plates corresponding to another exemplary embodiment of the invention.

Reference will now be made to FIG. 8, which shows part of another exemplary embodiment of a double-floor construction. The same parts and parts with the same function as those of the preceding exemplary embodiment have been given the same reference numbers, to which the letter "a" has been added.

The exemplary embodiment of FIG. 8 differs from the preceding one primarily in that an additional latching projection 22 and a latching recess 23 are provided on opposite edgings 8*a* of the floor plates 1*a*.

The edgings 8*a* which butt up against each other when pressure is exerted form a first sealing plane. The latching projection 22 engaging in the latching recess 23 provides the double-floor construction with an additional sealing effect. Finally, projecting sidepieces 10*a* of the edgings 8*a* engage in the U-section 16*a*, the closed part of which faces downward and thus serves as a sealing barrier, which allows no liquid whatever to pass through.

Figure 1:
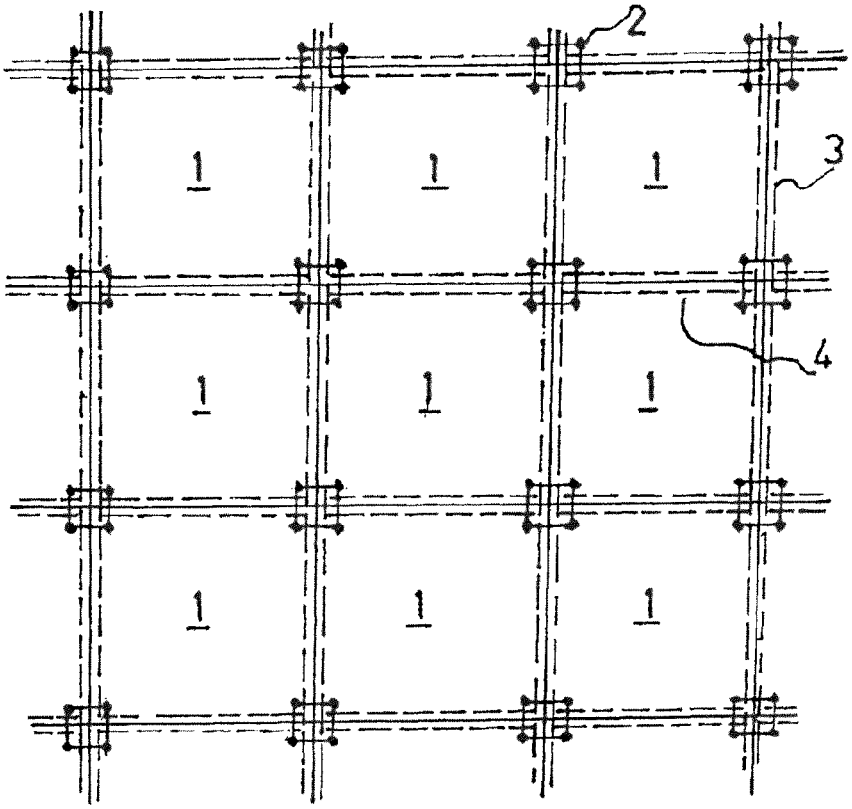
FIG. 1 shows a top view of a double-floor construction according to the invention.
Figure 2:
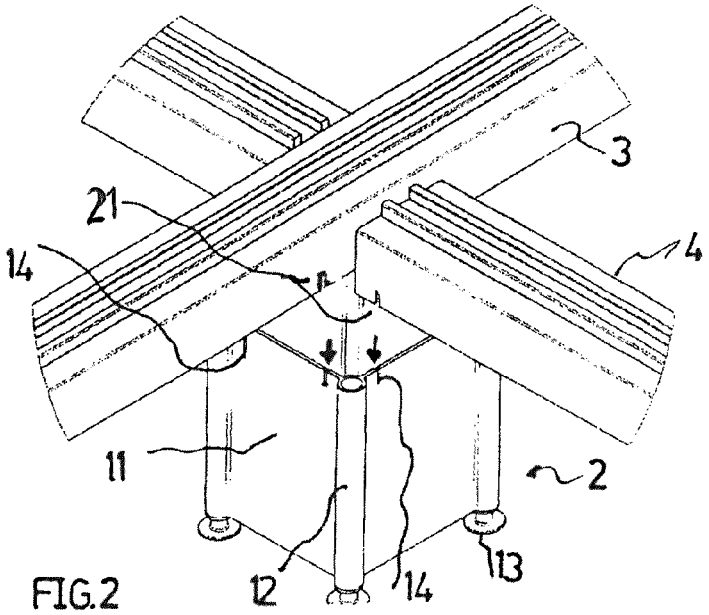
FIG. 2 shows a perspective view of an upright for a support structure for the double-floor construction of FIG. 1.
Figure 3:
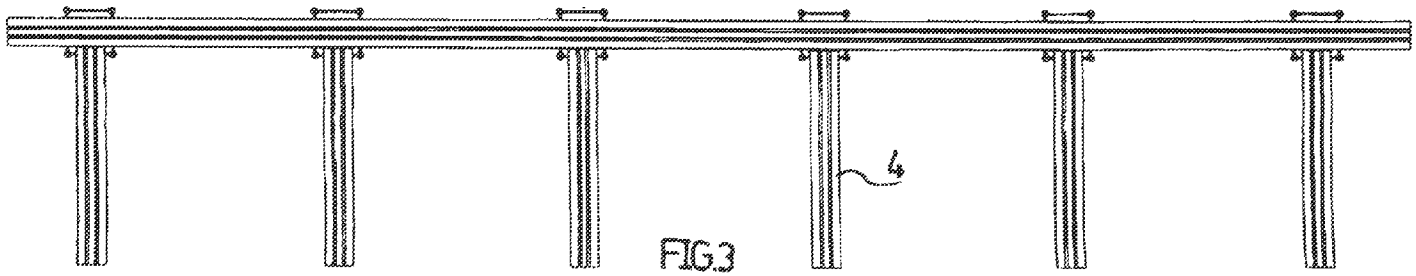
FIG. 3 shows a top view of part of the support structure of the double-floor construction of FIG. 1.
Figure 4:
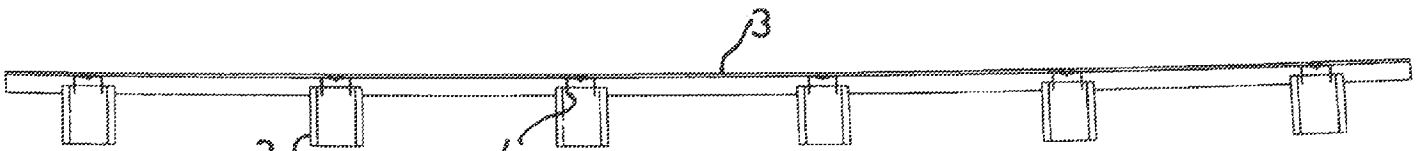
FIG. 4 shows a side view of part of the support structure of the double-floor construction of FIG. 1.
Figure 5:
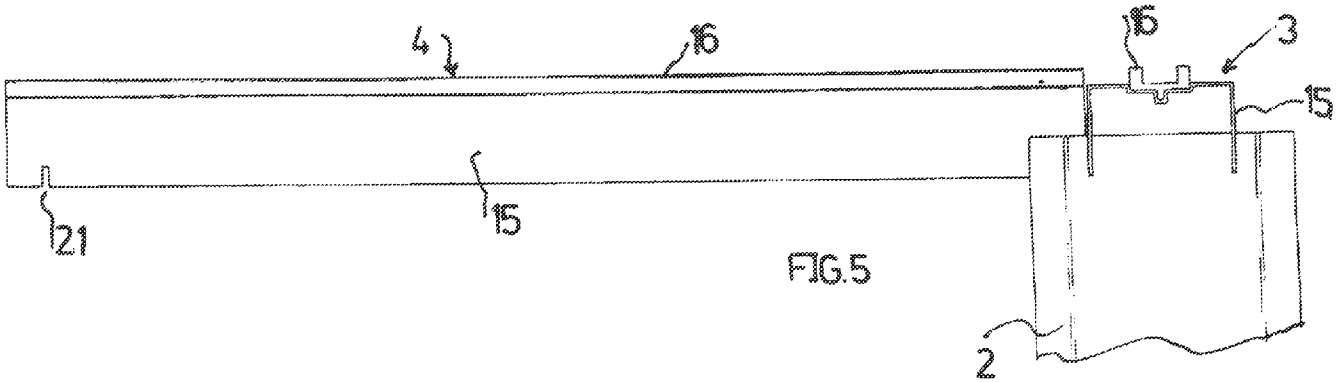
FIG. 5 shows a side view of an upright of the support structure of FIG. 1.
Figure 9:
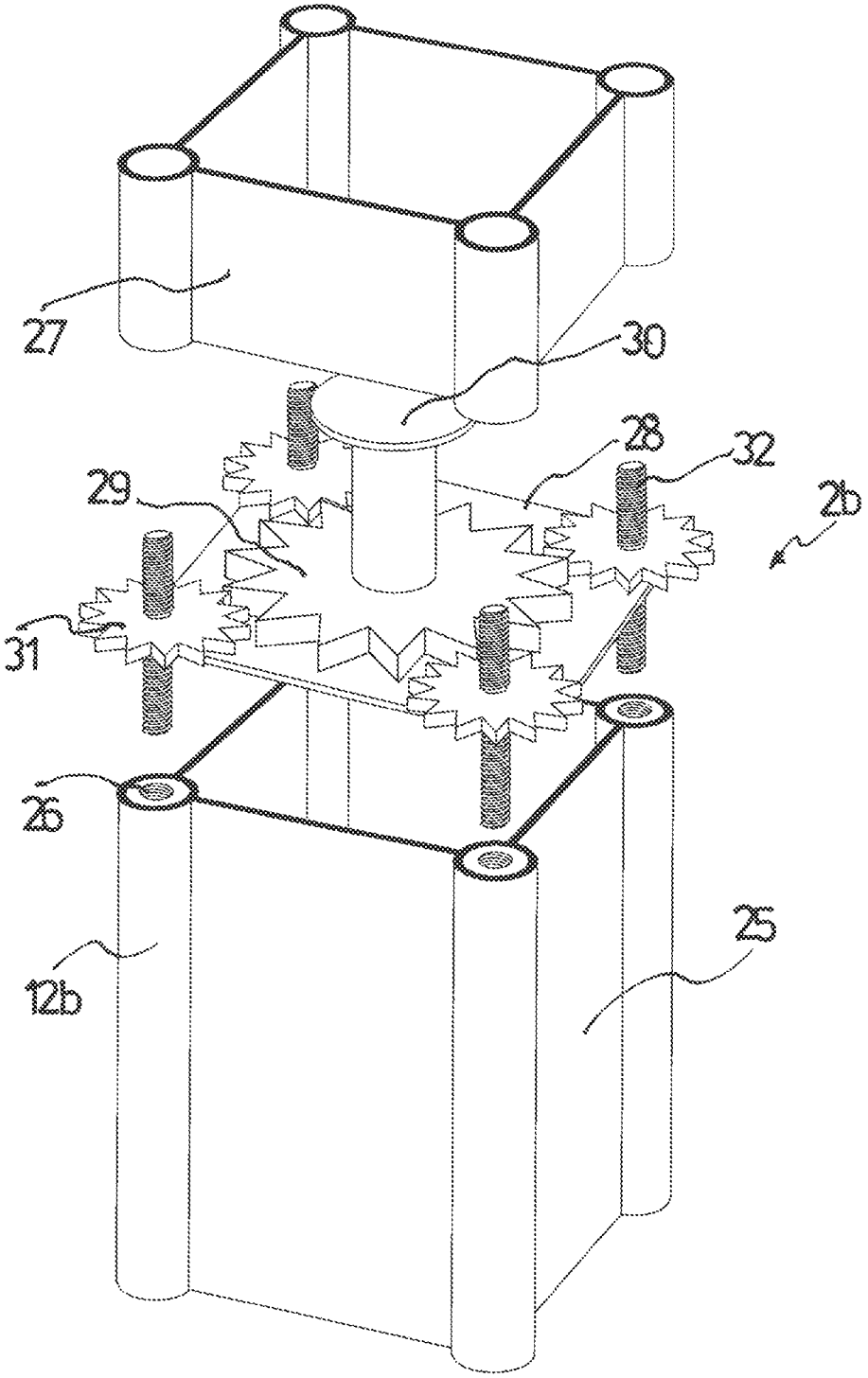
FIGS. 9 and 10 show another upright, which can be adjusted by means of a magnetic coupler.
Figure 10:
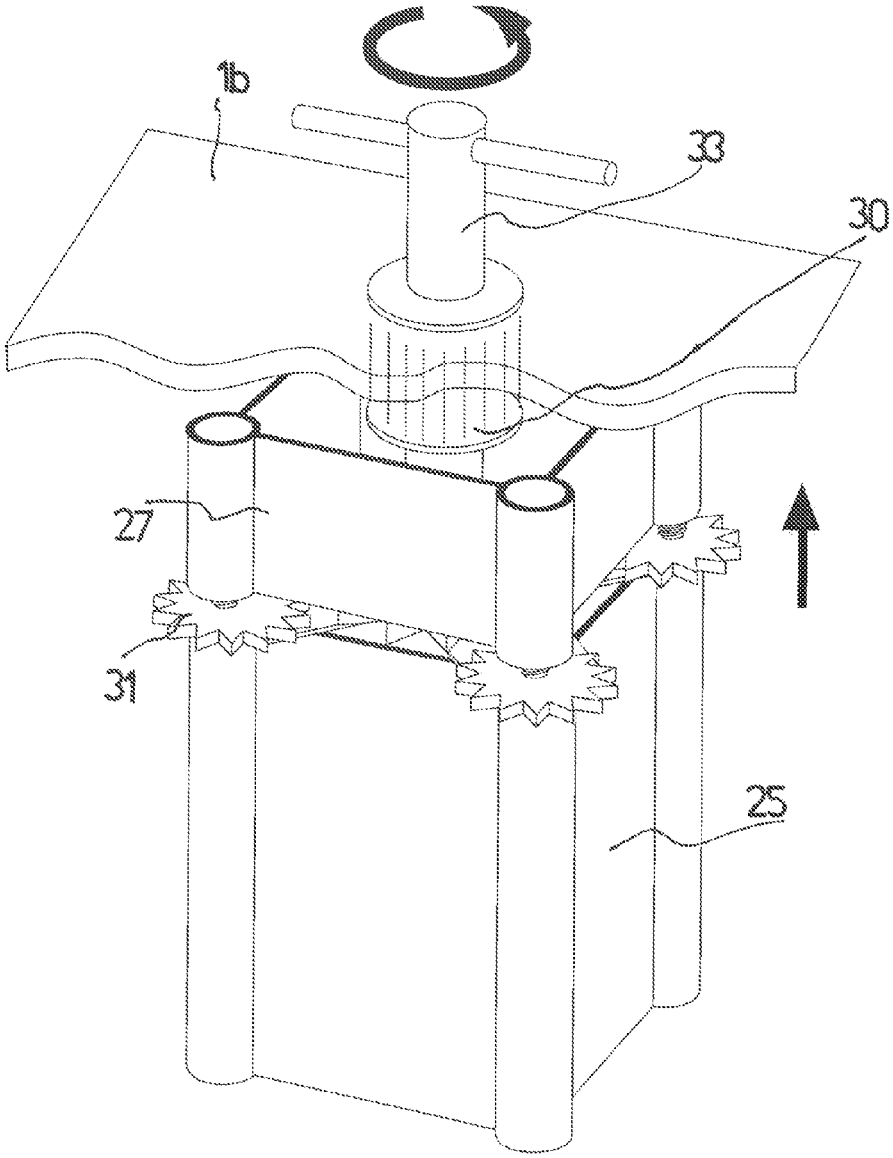

FIGS. 9 and 10 show an upright 2*b*, which comprises a lower part 25, which is the same as the upright 2 shown in FIG. 2 with respect to its basic outline. The feet corresponding to the feet 13 are not shown in FIG. 9 or FIG. 10.

A threaded bushing 26 is installed nonrotatably in the upper end of each of the four vertical sleeves 12*b*.

On top of the lower part 25, the upright 2*b* comprises an upper part 27, which has the same horizontal cross section as the lower part 25; slots for the suspension of the support rails are formed in its upper edge (not shown).

On an intermediate plate 28, which can be placed on the lower part 25, a gear wheel 29 is supported with freedom to rotate. A magnetic coupling device 30 projects axially from it.

The gear wheel 29 engages with four gear wheels 31 rotatably supported on the intermediate plate 28; a threaded bolt 32 passes through each of these four gear wheels but is not free to rotate in them. Each threaded bolt 32 engages in one of the threaded bushings 26.

With the help of the magnetic wrench 33 shown in FIG. 10, the upper part 27 of the upright 2*b* can be adjusted after the floor plates 1*b* have been laid. When the magnetic coupling device 30 is turned by the magnetic wrench 33, the gear wheel 29 drives the four gear wheels 31, so that the four threaded bolts 32 rotate along with them and move up in the threaded bushings 26, thus lifting the upper part 27. By the use of right-handed/left-handed threads, action in both directions is possible.

In a departure from the exemplary embodiment shown, it would also be possible to provide threaded bushings only in the upper part 27 or to connect them nonrotatably to the intermediate plate 28. It should be obvious that this requires corresponding combinations of right-handed and left-handed threads.

Figure 11:
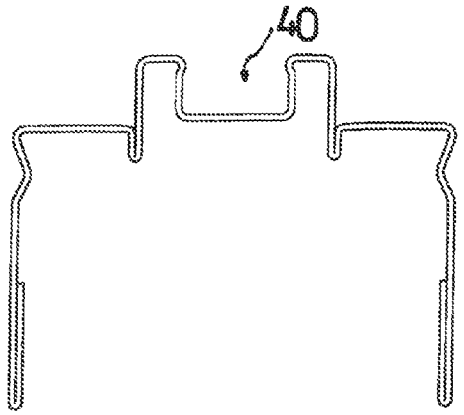
FIGS. 11-13 show cross sections of additional exemplary embodiments of support rails of the double-floor construction.
Figure 12:
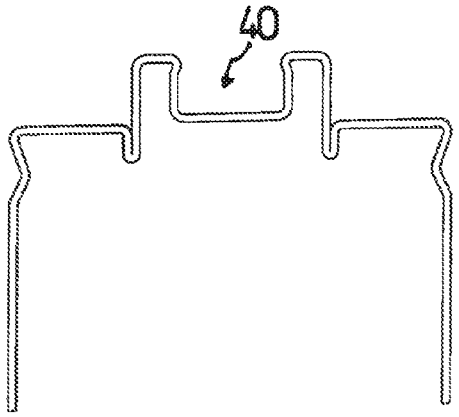
Figure 13:
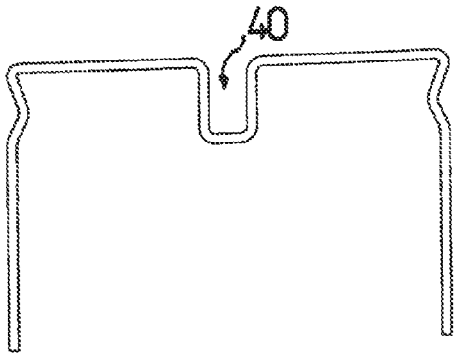

In a departure from the exemplary embodiment described above, the support rails 3, 4 can be manufactured as one-piece units; that is, they can be bent out of a single piece of sheet steel. FIGS. 11-13 show cross sections of various exemplary embodiments of such support rails. Each support rail forms a longitudinal channel 40, into which the hooking sidepieces formed on the edges of the floor plates can be inserted.

The section 16 of the two-part support rails 3, 4 described further above could be extruded from copper, for example, instead of from aluminum, copper being more highly conductive. In conjunction with conductive floor plates, such sections offer in particular the advantage that they can carry electricity away from the surface flooring. The hooking sidepieces which engage in the longitudinal channel of the section 16 and which are connected integrally to the joint material can be made of, for example, conductive polyurethane. It is then possible for defined leakage currents to flow away via the sections 16.

Figure 14:
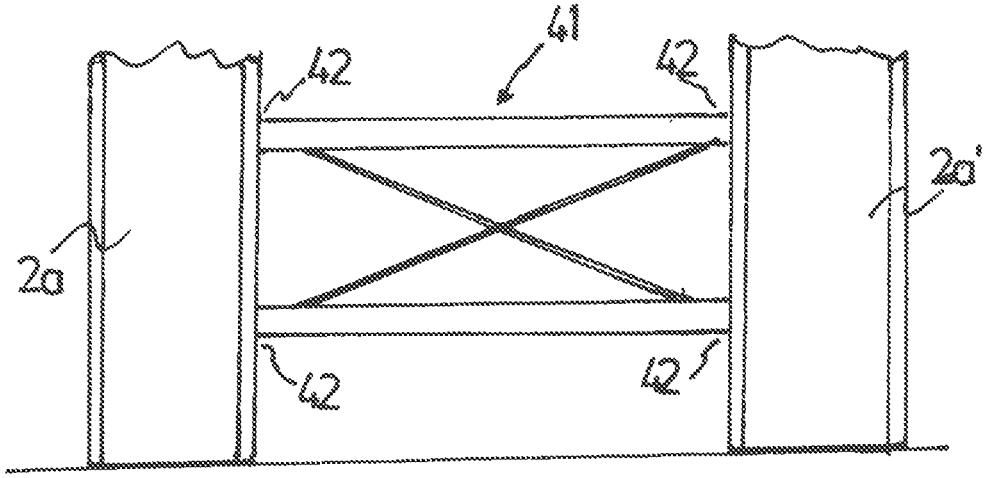
FIG. 14 shows a transverse stiffener between elongated uprights of an inventive stage floor.
Figure 15:
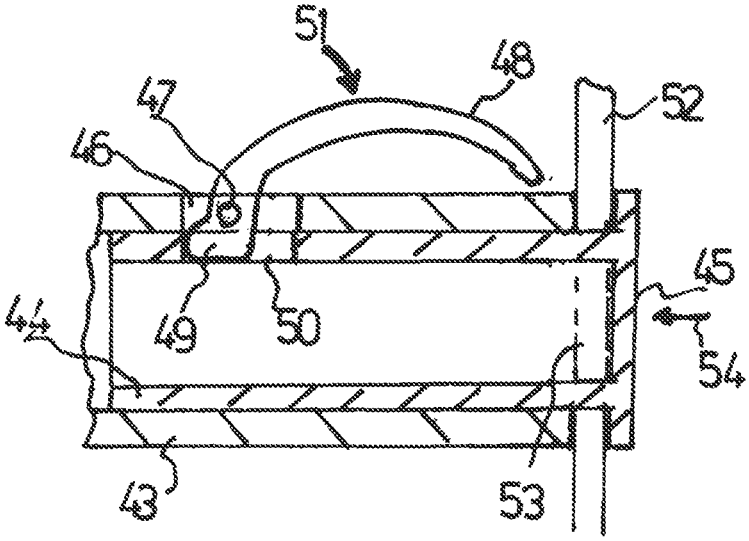
FIG. 15 shows a quick-connect clamp for attaching the transverse stiffener of FIG. 14 to the uprights of the stage floor.

As shown in FIG. 14, transverse stiffeners 41, extending between the tall uprights 2*a* and 2*a*' of a stage floor (not otherwise shown), can be attached at points 42 by means of the quick-connect clamps shown in FIG. 15.

The quick-connect clamp comprises an outside tube 43 and an inside tube 44, guided through the outside tube 43. The inside tube is connected at one end to a clamping head 45. A knee lever 48 rotatably supported in an opening 46 in the outside tube at 47 has an eccentric head 49, which engages in an opening 50 in the inside tube 44. By pivoting the knee lever 48 in the direction of the arrow 51, the clamping head 45, which passes through an opening 53 in a wall 52 of the upright 2*a* or 2*a*' and which grips the wall 52 from behind, can be moved in the direction of the arrow 54. The wall 52 will thus be clamped between the end surface of the outside tube 43 and the clamping head 45.

Designs which make use of a screwing action to shift the stiffener longitudinally and thus to perform the clamping function would also be possible.

The invention claimed is:

1. A double-floor construction, comprising: floor plates; and a support structure to be built on a subfloor, the floor plates being placeable on the support structure with edges of the floor plates abutting each other, wherein the support structure comprises support rails, which extend underneath the butt joints between the floor plates and along the butt joints and which are held at a certain distance from the subfloor by uprights of the support structure, the uprights being configured to be arranged underneath corners of the floor plates; and the floor plates and the support rails comprise contrivances to allow the floor plates to be set vertically down onto the support rails under horizontal compression of the edges of the floor plates forming the butt joints, wherein each of the support rails comprises a horizontal channel extending under an associated butt joint, wherein the contrivances of the floor plates are hooking sidepieces formed on the edges of the floor plates, the hooking sidepieces being vertically insertable into the channel so that the hooking sidepieces of the abutting floor plates lock into place within the channel when vertically inserted and secure the floor plates against movement in both vertical directions by locking projections.

2. The double-floor construction according to claim 1, wherein the longitudinal channel of each support rail is formed by a U-section of a material different from that of a remainder of the support rail.

3. The double-floor construction according to claim 2, wherein the U-section is made of aluminum or plastic.

4. The double-floor construction according to claim 2, wherein the U-section comprises a projection on each inside surface of sides of the U-section.

5. The double-floor construction according to claim 1, wherein the contrivances which allow the floor plates to be set down vertically onto the support rails are formed on an intermediate layer, which is foamed or sprayed between a backing layer and a decorative layer of the floor plates.

6. The double-floor construction according to claim 1, wherein the uprights comprise seatings that accept the support rails extending continuously over several of the uprights.

7. The double-floor construction according to claim 6, wherein the seatings are edge slots.

8. The double-floor construction according to claim 7, wherein the support structure comprises further support rails extending perpendicularly to the support rails laid continuously over several of the uprights.

9. The double-floor construction according to claim 8, wherein the further support rails extending between the continuously laid support rails are suspended from the uprights.

10. The double-floor construction according to claim 1, wherein the uprights comprise an adjustable three-point or four-point base by which the uprights rest on the subfloor.

11. The double-floor construction according to claim 10, wherein the three-point or four-point base are remotely adjustable through the placed floor plates.

12. The double-floor construction according to claim 6, wherein the uprights are rectangular boxes which are open at one end or at two opposite ends.

13. The double-floor construction according to claim 12, wherein opposing walls of the rectangular box comprise openings at an upper edge to provide the seating.

14. The double-floor construction according to claim 1, wherein the support rails comprise stops that prevent shifting in a longitudinal direction against the uprights, wherein the stops are slots by which the support rails are suspended from the uprights.

15. The double-floor construction according to claim 1, wherein butt joints between the edges of the floor plates form a first sealing plane, and at least one other sealing plane is formed by peripheral latching projections and latching recesses or by an insertion groove, which is closed at a bottom and extends under the butt joints.

16. The double-floor construction according to claim 1, wherein both the hooking sidepieces and the support rails are conductive, wherein in particular a part of the support rails which is in contact with the hooking sidepieces is conductive.

* * * * *